US005786317A

United States Patent [19]

Townsend

[11] Patent Number: 5,786,317

[45] Date of Patent: Jul. 28, 1998

[54] STAIN REMOVAL COMPOSITIONS FOR CARPETS

[76] Inventor: Clint E. Townsend, 8882 Nimbus Way, Orangevale, Calif. 95662

[21] Appl. No.: 754,970

[22] Filed: Nov. 22, 1996

[51] Int. Cl.[6] ..... C11D 3/08; C11D 3/33

[52] U.S. Cl. ..... 510/278; 510/280; 510/426; 510/432; 510/480; 510/492; 510/495; 510/511

[58] Field of Search ..... 510/278, 276, 510/280, 357, 426, 432, 480, 492, 495, 511

[56] References Cited

U.S. PATENT DOCUMENTS

| | | | |
|---|---|---|---|
| 3,721,629 | 3/1973 | Goodenough | 510/108 |
| 3,852,220 | 12/1974 | Kimmel et al. . | |
| 4,164,477 | 8/1979 | Whitley . | |
| 4,268,406 | 5/1981 | O'Brien et al. | 510/237 |
| 4,414,128 | 11/1983 | Goffinet . | |
| 4,440,661 | 4/1984 | Takeuchi et al. | 510/278 |
| 4,618,444 | 10/1986 | Hudson et al. . | |
| 4,749,508 | 6/1988 | Cockrell, Jr. et al. | 510/201 |
| 4,769,172 | 9/1988 | Siklosi . | |
| 4,772,415 | 9/1988 | Adone . | |
| 4,877,549 | 10/1989 | Cockrell, Jr. et al. | 134/40 |
| 4,921,629 | 5/1990 | Malihi et al. . | |
| 5,002,684 | 3/1991 | Beck et al. | 8/137 |
| 5,019,289 | 5/1991 | Gray et al. | 510/303 |
| 5,158,710 | 10/1992 | Van Eenam . | |
| 5,316,688 | 5/1994 | Gladfelter et al. . | |
| 5,348,679 | 9/1994 | Weinhold et al. | 510/370 |
| 5,387,375 | 2/1995 | Erilli et al. | 510/424 |
| 5,389,305 | 2/1995 | Repinec et al. | 510/237 |
| 5,439,610 | 8/1995 | Ryan et al. | 510/280 |
| 5,510,047 | 4/1996 | Gabriel et al. | 510/222 |
| 5,591,703 | 1/1997 | Sadlowski | 510/220 |
| 5,597,789 | 1/1997 | Sadlowski | 510/230 |

*Primary Examiner*—Douglas J. McGinty
*Assistant Examiner*—Lorna M. Douyon
*Attorney, Agent, or Firm*—John P. O'Banion

[57] ABSTRACT

A stain remover composition and method of use which selectively reduces food and beverage dyes in carpet stains without causing fading or discoloration of carpet dyes present in carpet fibers. The stain remover composition comprises generally between approximately 0.1 weight percent and approximately 2 weight percent of alkali metal silicate, between approximately 4 weight percent and approximately 12 weight percent of water soluble alcohol, between approximately 1 weight percent and approximately 5 weight percent of sequestering agent, between approximately 0.1 weight percent and approximately 2 weight percent of surfactant, between approximately 4 weight percent and approximately 12 weight percent of sodium bisulfite or other mild reducing agent, and the remainder water. The stain remover composition is generally prepared and stored as two separate solutions, with one solution containing the reducing agent and the other solution containing the remaining ingredients. The two solutions are mixed together prior to use, and then applied to a carpet stain, followed by steam heating of the treated carpet stain and water extraction of the treated stain.

14 Claims, No Drawings

STAIN REMOVAL COMPOSITIONS FOR CARPETS

BACKGROUND OF THE INVENTION 1. Field of the Invention

This invention pertains generally to compositions and formulations for cleaning and removing stains from carpets and like fabrics, and more particularly to aqueous stain removal compositions and a method of use which selectively chemically reduce and remove food dyes in stains on carpets without affecting dyes originally present in carpets. 2. Description of the Background Art Carpets, upholstery, and like fabrics which are used for residential and commercial applications are prone to damage during regular use due to spillage of foods, beverages, paints or other pigment-containing materials onto the fabrics. Carpets are particularly susceptible to food and beverage stains because of their location on the floor where spills are likely to occur and because of the absorbent nature of carpet pile fabrics. Many food materials, once spilled on a carpet, can leave stains which are difficult or impossible to entirely remove. Certain food dyes, such as red food colorings present in many beverages, can cause intractable carpet stains which have heretofore been impossible to effectively remove from carpets.

Various detergent, cleaner, and stain remover formulations have been developed for treatment of carpets to remove unwanted stains. Fabric protection materials such as silicone and fluorocarbon coatings have also been developed to prevent penetration of stains into carpets. The currently available cleaners and stain removers, however, generally are not effective at removal of many stains from carpets, including carpets which have been treated with carpet protectors such as SCOTCHGUARD®. Treatment of stains with currently available cleaners frequently fails to entirely remove the stains even after multiple applications of cleaner solutions. Further, currently available stain remover formulations are unable to discriminate between dyes due to food stains present in a carpet and the original carpet dyes or pigments, and thus can damage carpets by removing or bleaching the original carpet dyes, resulting in fading or discoloration of treated carpets. Treatment of a carpet stain with conventional carpet cleansers thus frequently and undesirably results in a faded carpet section where the treatment has been applied, together with an incompletely removed stain thereon.

Accordingly, there is a need for stain remover compositions and a method of use therefor which effectively remove food stains and other unwanted stains from carpets and like fabrics, which provide for quick and easy use, and which do not damage carpets or cause fading or bleaching of dyes originally present in carpets. The present invention satisfies those needs, as well as others, and generally overcomes the deficiencies found in the background art.

SUMMARY OF THE INVENTION

The present invention is a stain remover composition and method of using the same which provides for quick and efficient removal of unwanted stains from carpets and other fabrics without harming the carpet or causing fading or discoloration of the carpet. The invention provides for removal of stains from fabrics by a chemical reduction reaction which selectively reduces dyes present in carpets due to food stains, beverage stains, and other stains to form colorless reaction products while leaving the original carpet dyes unaltered. In general terms, the composition comprises a builder compound, a water-soluble organic solvent, a water-soluble sequestering agent, a surfactant, a reducing agent, and water.

By way of example, and not of limitation, the preferred stain remover composition of the invention comprises between approximately 0.1 weight percent and approximately 10 weight percent of builder compound, between approximately 2 weight percent and approximately 20 weight percent of water soluble organic solvent, between approximately 0.1 weight percent and approximately 5 weight percent of sequestering agent, between approximately 0.1 weight percent and approximately 5 weight percent of surfactant, between approximately 2 weight percent and approximately 20 weight percent of reducing agent, and the remainder water. The builder compound preferably comprises an alkali metal silicate, carbonate, phosphate, sulfate or borate, or mixture thereof. The water soluble organic solvent preferably comprises an alcohol such as isopropanol, ethanol or methanol, or mixtures thereof. The sequestering agent preferably comprises ethylenediaminetetraacetic acid (EDTA) or alkali metal salts thereof, or nitrilotriacetic acid (NTA) or alkali metal salts thereof. The surfactant preferably comprises an alkali metal $C_{10}$–$C_{16}$ alkyl sulfate such as sodium lauryl sulfate, or an alkali metal $C_{10}$–$C_{16}$ alkyl sulfonate anionic surfactant. The reducing agent preferably comprises sodium bisulfite or sodium hypophosphite.

The stain remover composition comprising the invention is preferably prepared and stored in two separate solutions. A first aqueous solution including an alkali metal silicate, alcohol, EDTA salt and anionic surfactant is prepared and stored separately from a second aqueous solution of sodium bisulfite, to maximize shelf life of the stain remover composition. Prior to use, the two aqueous solutions are mixed together and applied to a stain on a carpet. The stained carpet portion to which the stain remover composition has been applied is briefly steam heated, causing the chemical reduction of the dyes or pigments present in the stain, followed by extraction with warm water to remove the chemical reduction products and excess stain remover composition.

The novel and unique stain remover composition comprising the present invention selectively reduces dyes and pigments present in intrusive carpet stains without affecting the original carpet dyes themselves, and thus avoids damage to carpet dyes or carpet fibers which occur with the use of previously known carpet stain remover formulations. The stain remover composition of the invention is highly effective at removing stains in carpets caused by foods, beverages and other materials, and is particularly effective at removal of red food dyes which have heretofore been impossible to remove from carpets without causing damage or fading to the carpet. The stain remover composition of the invention is also effective at removal of stains caused by furniture dyes, rust and other commonly used materials that contain dyes or pigments which can discolor or damage carpets.

The removal of stains by the present invention is carried out generally by the selective reduction of the dyes present in stains to form non-colored or slightly colored reaction products which can be removed from a carpet by water extraction. The sodium bisulfite reducing agent of the composition generally cannot selectively reduce food dyes in stains unless each of the other ingredients of the composition are present. The alkali metal silicate or other builder compounds increase the sodium bisulfite reactivity and allow the reducing reaction to occur quickly without undesirable waiting periods. Additionally, the reducing reaction proceeds quickly enough so that the sodium bisulfite reducing agent does not reduce the carpet pigments themselves, thus avoiding fading or discoloration of carpets. The sequestering agent prevents undesirable precipitants from forming which could hinder stain removal. The surfactant helps penetrate into the carpet and aids in loosening food dye particles from carpet fibers. The alcohol serves as a hydrotrope for the other components of the composition, and also aids in the solubilization and separation of food dye particles from carpet fibers.

An object of the invention is to provide a stain remover composition and method of use which selectively reduces food dyes and other stain pigments in carpets while leaving original carpet dyes unaffected.

Another object of the invention is to provide a stain remover composition and method of use which does not damage carpets or result in fading or discoloration of carpets.

Another object of the invention is to provide a stain remover composition and method of use which is effective at removing red food coloring stains from carpets.

Another object of the invention is to provide a stain remover composition and method which is quick and easy to use.

Another object of the invention is to provide a stain remover composition and method of use which is water-based and includes no hazardous components.

Another object of the invention is to provide a stain remover composition and method of use which provides for long shelf life prior to use.

Further objects and advantages of the invention will be brought out in the following portions of the specification, wherein the detailed description is for the purpose of fully disclosing preferred embodiments of the invention without placing limitations thereon.

DESCRIPTION OF THE PREFERRED EMBODIMENTS

In accordance with the present invention, there is disclosed a stain remover composition and method of use for selectively reducing dyes or pigments resulting from stains from food and other materials which have been inadvertently spilled onto carpets or other fabrics. While the invention is disclosed generally in terms of removal of food and beverage stains from carpets, it should be readily apparent to those of ordinary skill in the art that the invention may be used for removal of numerous types of stains from numerous types of fabrics, including upholstery, drape, curtain, bedding and garment fabrics. The term "carpet" as used herein refers generally to pile fabric and woven fabric materials used as residential and commercial floor coverings.

Food dyes typically comprise highly colored organic molecules which can undergo chemical reduction to form colorless or slightly colored chemical species. The stain remover composition of the invention is able to penetrate into stain sites in carpets to reach food dye molecules adhering on carpet fibers, and to loosen and separate food dyes and food particles containing dyes from carpet fibers so that the food dyes are exposed to and susceptible to reducing agents. The colorless or chemical reduction products of the food dyes can then subsequently be removed from carpets by water rinsing or water extraction. The stain remover composition comprising the present invention is able to selectively chemically reduce food dye molecules to colorless reaction products without also causing chemical reduction of carpet dyes or pigments. This selectivity is made possible by the unique stain removal composition provided by the present invention.

The above useful features are provided by an aqueous stain remover composition which generally comprises one or more builder compounds, one or more water soluble organic solvents, one or more sequestering agents, one or more surfactants, one or more reducing agents, and water. Preferably, the stain remover composition comprises between approximately 0.1 weight percent and approximately 10 weight percent of builder compound, between approximately 2 weight percent and approximately 20 weight percent of water soluble organic solvent, between approximately 0.1 weight percent and approximately 10 weight percent of sequestering agent, between approximately 0.1 weight percent and approximately 10 weight percent of surfactant, between approximately 2 weight percent and approximately 20 weight percent of reducing agent, and the remainder water. More preferably, the stain remover composition of the invention comprises between approximately 0.1 weight percent and approximately 3 weight percent, preferably approximately 2 weight percent of builder compound, between approximately 4 weight percent and approximately 12 weight percent of water soluble organic solvent, between approximately 1 weight percent and approximately 5 weight percent of sequestering agent, between approximately 0.1 weight percent and approximately 2 weight percent of surfactant, between approximately 4 weight percent and approximately 12 weight percent of reducing agent, and the remainder water.

The builder compound used with the stain remover composition comprising the invention should be a material which overcomes water hardness, increases alkalinity and provides buffering, increases or enhances the reactivity of the reducing agent, and which generally aids in fabric cleaning. Suitable builder compounds include alkali metal silicates, alkali metal carbonates, alkali metal phosphates, alkali metal sulfates, and alkali metal borates. The preferred builder compounds for use with the invention are alkali metal silicates and hydrates thereof. Alkali metal silicates which may be used in accordance with the invention include sodium and/or potassium ortho, meta, di-, tri-, tetra-, and sesquisilicates, including sodium orthosilicate, sodium metasilicate, sodium sesquisilicate, sodium disilicate, sodium trisilicate, sodium tetrasilicate, and hydrates thereof. The above-listed alkali metal silicates may be used individually or in various combinations, as well as in combination with alkali metal carbonates, alkali metal phosphates, alkali metal sulfates and/or alkali metal borates.

The water soluble organic solvent used with the stain remover composition comprising the invention should serve as a co-solvent with water to aid in the penetration of food stains in carpets and loosening, solubilizing and separating of food materials from carpet fibers to expose food dyes to the reducing agent, and should also preferably serve as a hydrotrope to enhance solubility of the builder compound, sequestering agent and surfactant of the invention in an aqueous solution. The term "water soluble" as used herein means substantially miscible in water, but not necessarily infinitely miscible. The water soluble organic solvent additionally should be resistant to chemical reduction by the reducing agent of the invention. The preferred water soluble organic solvents are water soluble alcohols such as methanol, ethanol, n-propanol, and isopropanol, which are highly soluble in water, which will not undergo chemical reduction, which are relatively volatile and thus easily removed after use, which are relatively odor free, and which present minimal environmental hazards. The above alcohols may be used individually or in various combinations, or with other water soluble organic solvents. Other water soluble alcohols which may be used with the invention include, ethylene glycol monomethyl ether, diethylene glycol monomethyl ether, propylene glycol monomethyl ether, alkyl CELLOSOLVE® compounds, alkyl CARBITOL® compounds, and N, N dialkyl ethanolamines. Water soluble ketones, esters, amides, nitriles, and compounds with other water soluble functionalities may also be used with the invention, but are less preferred.

The sequestering agent or sequestrant used with the stain remover composition comprising the invention serves to prevent formation of water insoluble precipitates which could hinder stain removal, to chelate minerals such as calcium ions present in food stains, and to aid generally in separating food dyes and food dye particles from carpet fibers and preventing their reattachment or re-association with carpet fibers. The sequestering agent used with the invention preferably comprises ethylenediaminetetraacetic acid (EDTA), mono-, di-, tri-, or tetraalkali metal EDTA salts, or various mixtures thereof. Other chemically similar sequestering agents which may be used include diethylenetriaminepentaacetic acid and alkali metal salts thereof, nitrilotriacetic acid (NTA) and alkali metal salts thereof, and N-hydroxyethyl-ethylendiaminetriacetic acid and alkali metal salts thereof. Another class of polycarboxylic acid salts which may be used with the invention as sequestering agents include alkali metal citrates, succinates, and other di- and tri-carboxylates, and alkali metal salts of low molecular weight polyacrylic and polymethacrylic acid.

The surfactant used with the invention aids in the separation of food dyes and food particles from carpet fibers and solubilizes food dyes and particles in the aqueous solution wherein the chemical reduction reaction occurs. The preferred surfactants for use with the invention are anionic in nature, and preferably comprise $C_{10}$–$C_{16}$ alkali metal alkyl sulfate salts, $C_{10}$–$C_{16}$ alkali metal alkyl sulfonate salts, $C_{10}$–$C_{16}$ alkali metal alkyl phosphate salts, $C_{10}$–$C_{16}$ alkali metal alkyl phosphonate salts, $C_{10}$–$C_{16}$ alkali metal alkyl carboxylate salts, or combinations thereof. The notation "$C_{10}$–$C_{16}$" as used herein indicates a straight chain alkyl group within the range of ten to sixteen carbon atoms in length. Also useful are $C_{10}$–$C_{16}$ alkyl aryl sulfates, sulfonates, phosphates and carboxylates, and branched alkyl sulfates, sulfonates, phosphates and carboxylates. More preferably, the sodium salt of $C_{12}$ or dodecyl or "lauryl" sulfate, sulfonate, phosphate and carboxylate, or mixtures thereof, are used with the invention, with sodium lauryl sulfate being the most preferred surfactant.

The preferred reducing agents for use with the invention are relatively mild, non-toxic, water-soluble compounds. A preferred reducing agent is sodium bisulfite (NaHSO3), which is water soluble, relatively non-toxic, has a good shelf life in aqueous solution, and which is a relatively mild reducing agent which does not indiscriminately reduce food dyes and other stain pigments as well as carpet dyes. Sodium bisulfite selectively chemically reduces food dyes which have been loosened from carpet fibers to form colorless reaction products while leaving the intrinsic carpet dyes within the carpet fibers unaffected. Potassium bisulfite ($KHSO_3$) also has the above desirable properties for use with the invention. Another similar class of reducing agents include hypophosphorous acid ($H_3PO_2$), and the alkali metal salts thereof, including sodium hypophosphite ($NaH_2PO_2$) and potassium hypophosphite ($KH_2PO_2$), which are water soluble, relatively non-toxic, relatively mild reducing agents. The alkali metal hypophosphites are generally available as and used in a monohydrate form. Alkali metal borohydrides, alkali metal cyanoborohydrides, and $BH_3$ complexes may also be used with the invention, but are generally stronger reducing agents and should be used in smaller quantities. Alkali metal salts of aluminum hydrides, alkylaluminum hydrides, and alkoxyaluminum hydrides are also contemplated for use as reducing agents with the invention, but are less preferred due to their higher reactivity.

A stain remover composition in accordance with the present invention which efficaciously and selectively reduces and removes red food dyes from stained carpet fabric comprises between approximately 0.5 weight percent and approximately 1 weight percent of sodium metasilicate, between approximately 7 weight percent and approximately 10 weight percent of isopropanol, between approximately 2 weight percent and approximately 3 weight percent of tetrasodium ethylenediaminetetraacetate tetrahydrate, between approximately 0.5 weight percent and approximately 1.5 weight percent of sodium lauryl sulfate, between approximately 7 weight percent and approximately 10 weight percent of sodium bisulfite, and the remainder water. Various other sodium silicates or mixtures thereof can be used in place of or together with sodium metasilicate, and methanol and/or ethanol may be used together with or in place of isopropanol. This particular composition is also effective at selectively reducing green, blue and other colored food dyes and household pigments which may be present in stains. The only food dyes or pigments identified that are not effectively reduced by the above composition are the yellow colorants present in mustard condiments. The above composition also effectively reduces metal oxides such as rust to remove the red color therefrom.

The above stain remover composition of the invention works effectively at removing stains from carpets at significantly different water dilution variations. Thus, when the relative quantities to each other of sodium metasilicate, isopropanol, tetrasodium ethylenediaminetetraacetate tetrahydrate, sodium lauryl sulfate and sodium bisulfite are maintained within about 15 percent, the amount of water used in the composition can be varied. Successful stain removal can be obtained using the invention as described above even with substantial water dilution. However, the optimum stain removal results are obtained when the stain remover composition of the invention is formulated as described above.

The stain remover composition of the invention is preferably formulated and stored as two separate solutions to maximize shelf life. Generally, a first aqueous solution containing sodium metasilicate and/or other builder compound, isopropanol and/or other water-soluble alcohol, tetrasodium ethylenediaminetetraacetate tetrahydrate and/or other sequestering agent, and sodium lauryl sulfate and/or other surfactant is prepared and stored separately from a second aqueous solution of sodium bisulfite and/or other reducing agent. The amount of water used in each of the first and second solutions may be varied provided that the overall desired weight percentages of the ingredients will be obtained when the first and second solutions are subsequently combined prior to use. Preferably, the first and second solutions are diluted with water such that, when they are subsequently mixed, a one-to-one volume ratio of first solution to second solution may be employed to provide a stain remover composition which is ready to use without further water dilution. The separately stored first and second aqueous solutions have a long (years) shelf life.

Prior to treatment of a stained carpet, the above-described first and second aqueous solutions are mixed together or combined so that the sodium metasilicate, isopropanol, tetrasodium ethylenediaminetetraacetate tetrahydrate, sodium lauryl sulfate and sodium bisulfite are present in a single solution. Following mixing, the stain remover composition in the combined solutions has a shelf life of between about five days and about fifteen days under ambient conditions.

Following mixing of the two solutions, the stain remover composition is applied to a stained portion, section or region of carpet. Preferably, the stain remover composition is applied to the stained carpet region with a hand-actuated sprayer to ensure even application. The amount of stain remover composition applied will vary depending upon the size and severity of the stain, the nature and thickness of the carpet, and the dilution level of the composition with water. Agitation is preferably employed, either by brush or by hand (with gloves worn) after application of the stain remover composition to the carpet, to ensure penetration of the composition into the stained carpet fibers. Preferably, the carpet fibers are "groomed" or oriented during agitation so that the carpet fibers stand up or otherwise are not matted together, to ensure even heating during a subsequent heating step. The best stain removal results are obtained when the stain remover composition of the invention is applied to a dry carpet, although the invention may be used on damp carpets.

Following application of the stain remover composition to the stained carpet region, the stain remover-treated carpet region is heated to effect the chemical reduction reaction of the food dyes. Preferably, heating is carried out by placing a clean, dry (or slightly damp) cloth or towel over the treated carpet region, followed by steam heating with a steam iron placed on the cloth. The steam iron is preferably heated to about 200° F., or generally the equivalent of the temperature setting for nylon materials, in order to apply steam heating. The duration of the steam heating will preferably be within the range of approximately 2 minutes to 5 minutes, and will generally vary depending upon the nature and severity of the stain to be removed, and the water dilution level of the stain remover composition used. Lower temperature heating for longer duration may alternatively be used.

After suitable heating of the treated carpet region as described above, the steam iron and towel are removed from the treated carpet region. The stain will generally have changed and lightened in color, or will have lost its color entirely, depending again upon the nature of the dye involved in the stain and the severity of the stain. Following removal of the steam iron and towel, the treated carpet region is extracted with warm water using a conventional carpet cleaning device to remove the chemical reaction products from the reduction reaction as well as any residual stain remover solution present. At this point, the stain should be removed from the carpet. If not, the above procedure can be repeated one or more times. Generally, incomplete stain removal using the above-described treatment is due to insufficient duration of heat application. Increasing the iron temperature for the steam heating step is generally not preferred, but increasing the duration of the heating provides good stain removal results. Multiple re-application of the stain remover composition to the same carpet location and repetition of the above procedure can result in carpet color loss in the treated area.

The stain remover composition of the invention and its method of use will be more fully understood by reference to the following examples which illustrate generally the practice of the invention.

EXAMPLE 1

Preparation of Stain Remover Composition.

A first solution was prepared in a clean, 55 gallon capacity polypropylene barrel by adding 35 gallons (approximately 291 lb, 132 kg) of warm (approximately 100° F.) water to the vessel. To this 35 gallons of warm water, 6 lb (2.73 kg) of sodium metasilicate was added, with stirring, followed by addition of 79 lb (35.9 kg) of 99% isopropanol, with stirring. VERSENE® tetrasodium ethylenediaminetetraacetate (EDTA) tetrahydrate (21 lb 2 oz, 9.6 kg) was then added, with stirring, followed by addition of 9 lb 7 oz (4.29 kg) of sodium lauryl sulfate, together with stirring. A small amount (approximately 1/4 teaspoon) of blue dye, and 1.4 oz (39.7 g) of Triton™X100 anionic detergent were then added, and the combined mix was stirred until all ingredients were dissolved. Water was then added to bring the total volume of the solution in the vessel to 55 gallons. The solution was then transferred into pint bottles, labeled, and stored.

A second solution was prepared by addition of 36 gallons of cool (approximately 75° F.) water to a clean vessel, followed by addition of 76 lb (34.55 kg) of sodium bisulfite and 1.4 oz (39.7 g) of Dowfax™2A1 nonionic detergent, with stirring until all solids were dissolved. The second solution was then transferred into pint bottles, labeled, and stored.

Prior to use on carpet stains, equal volumes of the first and second solutions were mixed together. The mixed solutions exhibited a shelf life of between about 5 days and 15 days.

EXAMPLE 2

Treatment of Carpet Stain

A carpet sample with the following characteristics was utilized in the procedure outlined in EXAMPLE 2:

| | |
|---|---|
| Color: | Tan |
| Style: | Saxony |
| Fiber Type: | Nylon |
| Face Weight: | 24 oz. |
| Stitch: | 3/16" |
| Gage: | 1/8" |
| Pile Height: | 3/8" |
| Stain Protector: | SCOTCHGUARD ® |

A rectangular piece of the above carpet sample of approximately 12" by 24" dimension was obtained. The SCOTCHGUARD® protector was removed by treatment of the carpet piece with an anionic detergent (pH 13), followed by hot water extraction with a commercial carpet cleaning tool. The carpet sample was then dried thoroughly.

A solution of sugar-free, cherry-flavored KOOLAID® (containing Red-40 food dye) was prepared by adding 1 packet (0.13 oz, 3.7 g) to 1 quart of warm (approximately 100° F.) tap water, followed by stirring, to provide a deep red aqueous solution.

The red KOOLAID® solution was applied by pouring to a 5" wide swath extending across the carpet sample. Approximately 1 oz. of red KOOLAID® solution was applied per 2 square inches of carpet sample, to provide a deep red stain on the carpet sample on the portions where the red KOOLAID® solution was applied.

The red KOOLAID® solution was allowed to remain on the carpet sample for 14 days at ambient (room) temperature, during which time the red stain caused by the KOOLAID® dried completely. The carpet sample was then rinsed via hot water extraction with a commercial carpet cleaning tool to remove any KOOLAID® and Red-40 dye that had not permanently bonded to the carpet fibers.

Equal volumes (8 oz. each) of the first and second solutions described above in EXAMPLE 1 were mixed together and transferred to the reservoir of a conventional hand-actuated trigger sprayer. A 4" by 6" portion of the KOOLAID®-stained carpet sample was treated with the combined first and second solutions by spray application of 1 oz. of combined solutions per 6 square inches of stained carpet surface. The treated area or region was then gently agitated with a nylon bristle brush for about 5 seconds to ensure penetration of the mixed solutions into the stained carpet.

A dry, white, light-weight terry cloth towel was then placed over the treated stain, with the edges of the towel extending by about 3" outward beyond the 4" by 6" region treated with the combined solutions. A Proctor Silex steam iron (#12150) was heated to about 200° F., and was placed on the towel over the treated stain, and was allowed to remain thereon and steam heat the area under the steam iron for 4 minutes, after which the steam iron and towel were removed from the carpet sample. The red stain had disappeared from the treated region of the carpet, and a pale yellow colored remained on the carpet in its place.

The carpet sample was then rinsed via hot water extraction using a commercial carpet extraction machine with a 4" "Upholstery Tool", resulting in the removal of the pale yellow color from the treated carpet. The original tan color of the carpet sample was unaltered by the above procedure and did not differ in color from the unstained, untreated portions of the carpet sample. The untreated portions of the stain remained bright red and exhibited no color change.

The above procedure in EXAMPLE 2 has been carried out successfully on several types of carpet samples, including carpet samples made from wool, polyester, aramid, and olefin fibers of several ply types and styles. The procedure of EXAMPLE 2 was also carried out on various wool, polyester, aramid, cotton and other upholstery fabrics with successful stain removal results generally identical to that described above.

The procedure outlined in EXAMPLE 2 has worked to successfully remove many other types of food dyes, beverage dyes and other pigments from carpet stains, including various food dyes of all colors, coffee, tea, wine, rust, and mold stains. As noted above, the only type of stain which was not effectively treated by the stain remover composition are stains caused by mustard condiments. It is not presently clear why mustard stains are resistant to the stain remover composition and procedure outlined in the above examples.

With regard to the stain remover composition described in EXAMPLE 1, it was found that substitution of various sodium and potassium silicates in place of or in combination with sodium metasilicate in the first solution provided identical results when used in the procedure described in EXAMPLE 2. It was also noted that methanol and/or ethanol could be used in place of or in combination with isopropanol in the first solution of EXAMPLE 1, to provide identical results using the procedure of EXAMPLE 2. Other chemically similar water soluble alcohols are also contemplated for use with the stain remover composition of the invention, as related above. It was further noted that the Triton™X100 can be omitted from the first solution, and that the Dowfax™2A1 can be omitted from the second solution, without affecting the results of the procedure of EXAMPLE 2. The blue dye included in the first solution serves merely to distinguish the first and second solutions and avoid user confusion, and may be omitted if desired. The blue dye undergoes reduction during the procedure outlined in EXAMPLE 2 and thus does not harm the treated carpet.

In EXAMPLE 1, the first solution as described above comprises approximately 122 lb of combined sodium metasilicate, isopropanol EDTA tetrasodium salt, and sodium lauryl sulfate in approximately 41 gallons (341 lb) of water, and the second solution comprises approximately 76 lb of sodium bisulfite in approximately 45 gallons (375 lb) water. These particular water dilution ratios were selected because they conveniently allow the stain remover composition of the invention to be obtained with the preferred weight percentages of ingredients upon mixing of equal volumes of the first and second solutions of EXAMPLE 1. The particular water dilution ratios for the first and second solutions described in EXAMPLE 1 may be varied if desired, however, without altering results of the procedure of EXAMPLE 2. Also, the overall water dilution level of the combined solutions can be increased while still providing effective stain removal, as noted above.

Numerous variations on the above-described stain remover composition, which will suggest themselves to those of ordinary skill in the art upon reading the present disclosure, are also considered to be within the scope of the present invention.

Accordingly, it will be seen that this invention provides a stain remover composition and method of using the same which allows quick and efficient removal of unwanted stains from carpets and other fabrics without harming the carpet or causing fading or discoloration of the carpet. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A stain remover composition, comprising:

(a) between approximately 0.1 weight percent and approximately 10 weight percent of at least one builder compound;

(b) between approximately 2 weight percent and approximately 20 weight percent of at least one water soluble organic solvent;

(c) between approximately 0.1 weight percent and approximately 10 weight percent of at least one sequestering agent selected from the group consisting of ethylenediaminetetraacetic acid, ethylenediaminetetraacetic acid monoalkali metal salt, ethylenediaminetetraacetic acid dialkali metal salt, ethylenediaminetetraacetic acid trialkali metal salt, and ethylenediaminetetraacetic acid tetraalkali metal salt;

(d) between approximately 0.1 weight percent and approximately 10 weight percent of at least one surfactant;

(e) between 7 weight percent and approximately 20 weight percent of at least one reducing agent selected from the group consisting of alkali metal bisulfite, alkali metal hypophosphite, and alkali metal borohydride; and (f) the remainder water.

2. A stain remover composition as recited in claim 1, wherein said builder compound is selected from the group consisting of alkali metal silicate salts, alkali metal carbonate salts, alkali metal phosphate salts, alkali metal sulfate salts, and alkali metal borate salts.

3. A stain remover composition as recited in claim 1, wherein said water soluble organic solvent is selected from the group consisting of methanol, ethanol, and isopropanol.

4. A stain remover composition as recited in claim 1, wherein said surfactant is selected from the group consisting of $C_{10}$–$C_{16}$ alkali metal alkyl sulfate salt, $C_{10}$–$C_{16}$ alkali metal alkyl sulfonate salt, $C_{10}$–$C_{16}$ alkali metal alkyl phosphate salt, $C_{10}$–$C_{16}$ alkali metal alkyl phosphonate salt, and $C_{10}$–$C_{16}$ alkali metal alkyl carboxylate salt.

5. A stain remover composition, comprising:

(a) between approximately 0.1 weight percent and approximately 10 weight percent of at least one alkali metal silicate;

(b) between approximately 2 weight percent and approximately 20 weight percent of at least one water soluble alcohol;

(c) between approximately 0.1 weight percent and approximately 10 weight percent of at least one sequestering agent;

(d) between approximately 0.1 weight percent and approximately 10 weight percent of at least one anionic surfactant;

(e) between 7 weight percent and approximately 20 weight percent of sodium bisulfite; and (f) the remainder water.

6. A stain remover composition as recited in claim 5, wherein said sequestering agent comprises ethylenediaminetetraacetate tetrasodium salt tetrahydrate.

7. A stain remover composition as recited in claim 6, wherein said anionic surfactant comprises sodium lauryl sulfate.

8. A stain remover composition as recited in claim 7, comprising of between approximately 0.1 weight percent and approximately 3 weight percent of said alkali metal silicate.

9. A stain remover composition as recited in claim 5, comprising of between approximately 4 weight percent and approximately 12 weight percent of said water soluble alcohol.

10. A stain remover composition as recited in claim 6, comprising of between approximately 1 weight percent and approximately 5 weight percent of said ethylenediaminetetraacetate tetrasodium salt tetrahydrate.

11. A stain remover composition as recited in claim 7, comprising of between approximately 0.1 weight percent and approximately 2 weight percent of said sodium lauryl sulfate.

12. A stain remover composition as recited in claim 5, comprising of between 7 weight percent and approximately 12 weight percent of said sodium bisulfite.

13. A stain remover composition as recited in claim 7, wherein:

(a) said alkali metal silicate comprises between approximately 0.5 weight percent and approximately 1 weight percent;

(b) said water soluble alcohol comprises between approximately 7 weight percent and approximately 10 weight percent;

(c) said ethylenediaminetetraacetate tetrasodium salt tetrahydrate comprises between approximately 2 weight percent and approximately 3 weight percent;

(d) said sodium lauryl sulfate comprises between approximately 0.5 weight percent and approximately 1.5 weight percent; and (e) said sodium bisulfite comprises between 7 weight percent and approximately 12 weight percent.

14. A two solution kit for producing, when mixed in a one-to-one volume ratio, a stain remover composition, comprising:

(a) a first aqueous solution, comprising:

(i) between approximately 0.1 weight percent and approximately 10 weight percent of at least one builder compound;

(ii) between approximately 2 weight percent and approximately 20 weight percent of at least one water soluble organic solvent;

(iii) between approximately 0.1 weight percent and approximately 10 weight percent of at least one sequestering agent; and (iv) between approximately 0.1 weight percent and approximately 10 weight percent of at least one surfactant and (b) a second aqueous solution, comprising between 7 weight percent and approximately 20 weight percent of at least one reducing agent selected from the group consisting of alkali metal bisulfite, alkali metal hypophospite, and alkali metal borohydride, wherein said weight percent values for both said first and said second aqueous solutions are final weight percent values for suitably diluted said first and said second aqueous solutions.

* * * * *